US009789717B2

(12) United States Patent
Tsuzawa et al.

(10) Patent No.: US 9,789,717 B2
(45) Date of Patent: Oct. 17, 2017

(54) IMAGE FORMING APPARATUS

(71) Applicant: FUJIFILM Corporation, Tokyo (JP)

(72) Inventors: Yoshiyuki Tsuzawa, Kanagawa (JP); Naoya Okano, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/445,159

(22) Filed: Feb. 28, 2017

(65) Prior Publication Data

US 2017/0165988 A1 Jun. 15, 2017

Related U.S. Application Data

(63) Continuation of application No. PCT/JP2015/062764, filed on Apr. 28, 2015.

(30) Foreign Application Priority Data

Sep. 19, 2014 (JP) ..... 2014-190915

(51) Int. Cl.
*B41J 29/377* (2006.01)
*B41J 11/00* (2006.01)
*B41J 2/01* (2006.01)

(52) U.S. Cl.
CPC ..... *B41J 29/377* (2013.01); *B41J 2/01* (2013.01); *B41J 11/0045* (2013.01)

(58) Field of Classification Search
CPC ..... B41J 29/377; B41J 2/01; B41J 11/0045
See application file for complete search history.

(56) References Cited

U.S. PATENT DOCUMENTS

2009/0073222 A1* 3/2009 Hori ..... B41J 2/01 347/33
2009/0317555 A1* 12/2009 Hori ..... B41J 2/0057 427/428.06
2013/0127962 A1 5/2013 Yoda

FOREIGN PATENT DOCUMENTS

JP 2004-219599 A 8/2004
JP 2007-233327 A 9/2007
(Continued)

OTHER PUBLICATIONS

International Search Report issued in PCT/JP2015/062764; dated Jul. 14, 2015.
(Continued)

*Primary Examiner* — Alessandro Amari
*Assistant Examiner* — Roger W Pisha, II
(74) *Attorney, Agent, or Firm* — Studebaker & Brackett PC

(57) ABSTRACT

There is provided an image forming apparatus that can stably discharge liquid from a liquid discharge head and can be reduced in size by a simple structure. In an image forming apparatus, a gas compressor is provided so as to face the peripheral surface of an image forming drum , which corresponds to a range positioned outside a transport range in which a recording medium is transported and deviating from the transport range in a circumferential direction. The gas compressor is adapted to blow secondary compressed gas, which is generated by primary compressed gas supplied from the outside of the apparatus and of which the temperature is low, to the peripheral surface. The secondary compressed gas, which is blown from the gas compressor, is guided to the peripheral surface by a guide part and is diffused along the direction of a rotation axis of the image forming drum.

20 Claims, 10 Drawing Sheets

(56) References Cited

FOREIGN PATENT DOCUMENTS

| | | | |
|---|---|---|---|
| JP | 2011-161840 | A | 8/2011 |
| JP | 2013-107275 | A | 6/2013 |

OTHER PUBLICATIONS

Written Opinion issued in PCT/JP2015/062764; dated Jul. 14, 2015.

* cited by examiner

IMAGE FORMING APPARATUS

CROSS-REFERENCE TO RELATED APPLICATIONS

This application is a Continuation of PCT International Application No. PCT/JP2015/062764 filed on Apr. 28, 2015, which claims priority under 35 U.S.C §119(a) to Japanese Patent Application No. 2014-190915 filed on Sep. 19, 2014. Each of the above application(s) is hereby expressly incorporated by reference, in its entirety, into the present application.

BACKGROUND OF THE INVENTION

1. Field of the Invention

The present invention relates to an image forming apparatus.

2. Description of the Related Art

JP2013-107275A discloses an ink jet printer as an image recording apparatus. Recording heads are disposed in the ink jet printer so as to face the peripheral surface of a platen drum. When a recording medium is transported to a gap between the peripheral surface of the platen drum and the recording head, ink is discharged from the recording head and an image is recorded on the recording medium.

In the ink jet printer, a cooling fan is provided so as to face a portion of the peripheral surface of the platen drum to which a recording medium is GX not transported, and the cooling fan is adapted to cool the platen drum. Accordingly, since the temperature distribution of a recording medium to be transported to the platen drum is suppressed, the formation of wrinkles of the recording medium is suppressed. As a result, a high-quality image can be formed.

SUMMARY OF THE INVENTION

Incidentally, ink is adjusted to a constant temperature in the ink jet printer. When the temperature of the image forming drum is higher than the temperature of ink by about several ° C., dew condensation occurs on the recording head. For this reason, the discharge of ink from the recording head becomes unstable. The image forming drum can also be cooled by the cooling fan. However, the structure of the cooling fan including a blade, a motor, and the like is complicated and the size of the cooling fan is large. For this reason, there was room for improvement on the ink jet printer.

The invention has been made in consideration of the above-mentioned fact, and an object of the invention is to obtain an image forming apparatus that can stably discharge liquid from a liquid discharge head and can be reduced in size by a simple structure.

In order to solve the above-mentioned problems, an image forming apparatus according to a first aspect of the invention comprises: a recording medium transport unit that is adapted to be capable of transporting a recording medium, which is capable of being held on an outer peripheral portion thereof, from one side of a rotation axis thereof to the other side of the rotation axis by rotating; a liquid discharge head that faces the outer peripheral portion of the recording medium transport unit in a transport range in which the recording medium transport unit is capable of transporting the recording medium and is capable of forming an image on the recording medium by discharging liquid to the recording medium, which is capable of being transported by the recording medium transport unit; and a gas compressor that faces a range positioned outside the transport range deviating from the transport range in a circumferential direction, of the outer peripheral portion of the recording medium transport unit, generates secondary compressed gas, of which the temperature is lower than the temperature of primary compressed gas supplied from the outside of the apparatus, from the primary compressed gas, and blows the secondary compressed gas to the range positioned outside the transport range.

In the image forming apparatus according to the first aspect, the recording medium transport unit can hold the recording medium on the outer peripheral portion thereof, and the recording medium can be transported from one side of a rotation axis thereof to the other side of the rotation axis when the recording medium transport unit rotates. The liquid discharge head is provided so as to face the outer peripheral portion of the recording medium transport unit in the transport range in which the recording medium transport unit is capable of transporting the recording medium. The liquid discharge head is capable of forming an image on the recording medium by discharging liquid to the recording medium that is capable of being transported by the recording medium transport unit. The secondary compressed gas is blown to the range, which is positioned outside the transport range and deviates from the transport range in a circumferential direction, of the outer peripheral portion of the recording medium transport unit from the gas compressor.

Here, since the secondary compressed gas of which the temperature is lower than the temperature of the primary compressed gas is blown to the range, which is positioned outside the transport range, of the recording medium transport unit from the gas compressor, the recording medium transport unit can be cooled. For this reason, the occurrence of dew condensation on the liquid discharge head can be effectively suppressed. Since the primary compressed gas is supplied to the gas compressor from the outside of the apparatus, only the gas compressor is provided in the apparatus and a device for generating the primary compressed gas is not provided in the apparatus. In addition, since the gas compressor generates the secondary compressed gas, of which the temperature is low, from the primary compressed gas, the structure of the gas compressor is simplified and the size of the gas compressor can be reduced.

According to a second aspect of the invention, in the image forming apparatus according to the first aspect, the gas compressor further includes an outlet that blows the secondary compressed gas along a direction of the rotation axis, and the image forming apparatus includes a guide part that guides the secondary compressed gas, which is blown from the outlet, to the range positioned outside the transport range and diffuses the secondary compressed gas in at least the direction of the rotation axis.

According to the image forming apparatus of the second aspect, the secondary compressed gas is blown along the direction of the rotation axis of the recording medium transport unit from the outlet of the gas compressor. The secondary compressed gas is guided to the range, which is positioned outside the transport range, of the recording medium transport unit from the direction of the rotation axis by the guide part, and is diffused at least in the direction of the rotation axis. For this reason, since the length of the flow passage of the secondary compressed gas to the range, which is positioned outside the transport range, from the outlet is increased, the secondary compressed gas to be blown to the recording medium transport unit can be widely diffused along the direction of the rotation axis. Accordingly, since the peripheral surface of the recording medium transport unit can be cooled in a wide range along the direction of the rotation axis, variation in cooling of the recording medium transport unit can be reduced. In addition, since the length of the flow passage of the secondary compressed gas is made along the direction of the rotation axis of the recording medium transport unit, the size of a space, which is required to ensure the length of the flow passage, is reduced. For this reason, the size of the image forming apparatus can be reduced.

According to a third aspect of the invention, in the image forming apparatus according to the second aspect, the guide part includes a guide plate that guides the flow of the secondary compressed gas, and an interior angle between a surface of the guide plate and the rotation axis of the recording medium transport unit is in the range of 30° to 50°.

According to the image forming apparatus of the third aspect, since the guide part includes the guide plate that is set at the angle, it is possible to reduce the amount of the secondary compressed gas that wastefully flows from the gas compressor in the axial direction of the recording medium transport unit. For this reason, since the secondary compressed gas can be guided toward the peripheral surface of the recording medium transport unit without waste, the cooling efficiency of the recording medium transport unit can be improved. In addition, since the secondary compressed gas can be guided by the guide plate, the structure of the guide part is simplified.

According to a fourth aspect of the invention, in the image forming apparatus according to the third aspect, guide walls, which guide the secondary compressed gas in a circumferential direction of the recording medium transport unit, stand at both end portions of the guide plate.

According to the image forming apparatus of the fourth aspect, the guide walls stand at both end portions of the guide plate and the secondary compressed gas is also guided in the circumferential direction of the recording medium transport unit by the guide walls. For this reason, since the secondary compressed gas also flows in the circumferential direction of the recording medium transport unit, the cooling efficiency of the recording medium transport unit can be further improved. In addition, it is possible to collect the secondary compressed gas, which is to be diffused in a direction in which the secondary compressed gas deviates from the recording medium transport unit, and to guide the secondary compressed gas to the peripheral surface of the recording medium transport unit by the guide plate and the guide walls of the guide part. For this reason, since the secondary compressed gas is efficiently used, the cooling efficiency of the recording medium transport unit can be further improved. Moreover, for example, in a case in which heat generating sources are present on the upstream side of the recording medium transport unit in the transport direction of the recording medium and on the downstream side of the recording medium transport unit in the transport direction of the recording medium, the secondary compressed gas is also guided in the circumferential direction of the recording medium transport unit by the guide walls. Accordingly, the wall of the secondary compressed gas can be formed between the recording medium transport unit and each heat generating source. For this reason, since heat, which is transferred to the recording medium transport unit from the heat generating sources, is blocked by the secondary compressed gas, a rise in the temperature of the recording medium transport unit can be effectively suppressed.

According to a fifth aspect of the invention, in the image forming apparatus according to any one of the second to fourth aspects, the guide part is provided immediately below the recording medium transport unit.

According to the image forming apparatus of the fifth aspect, since the guide part is provided immediately below the recording medium transport unit, the length of the flow passage to the peripheral surface of the recording medium transport unit from the guide part is shortest. For this reason, since the secondary compressed gas is blown to the peripheral surface of the recording medium transport unit while maintaining a low temperature, the cooling efficiency of the recording medium transport unit can be further improved.

According to a sixth aspect of the invention, in the image forming apparatus according to any one of the second to fourth aspects, the guide part is provided on the downstream side of a position, which is present immediately below the recording medium transport unit, in a transport direction of the recording medium.

According to the image forming apparatus of the sixth aspect, since the guide part is provided on the downstream side of a position, which is present immediately below the recording medium transport unit, in the transport direction, more secondary compressed gas can be guided to the downstream side in the transport direction than the upstream side in the transport direction in the circumferential direction of the recording medium transport unit. For example, drying processing units are provided on the downstream side of the recording medium transport unit in the transport direction in the image forming apparatus, and the drying processing units are heat generating sources that generate a large amount of heat. For this reason, since the wall of the secondary compressed gas can be formed between the recording medium transport unit and the heat generating source and heat, which is transferred to the recording medium transport unit from the heat generating source, is blocked by the secondary compressed gas, a rise in the temperature of the recording medium transport unit can be effectively suppressed.

According to a seventh aspect of the invention, in the image forming apparatus according to the second aspect, the guide part includes a curved surface or a polygonal surface that protrudes toward a peripheral surface of the recording medium transport unit and guides the secondary compressed gas, or a curved surface or a polygonal surface that is recessed toward a side opposite to the peripheral surface of the recording medium transport unit and guides the secondary compressed gas.

According to the image forming apparatus of the seventh aspect, since the guide part includes a curved surface or a polygonal surface that protrudes toward the peripheral surface of the recording medium transport unit, it is possible to further diffuse the secondary compressed gas, which is guided from the gas compressor by the guide part, in the axial direction of the recording medium transport unit. For this reason, the peripheral surface of the recording medium transport unit can be cooled in a wide range along the direction of the rotation axis. Further, since the guide part includes a curved surface or a polygonal surface that is recessed toward the side opposite to the peripheral surface of the recording medium transport unit, it is possible to cool a specific portion of the peripheral surface of the recording medium transport unit with the secondary compressed gas, which is guided from the gas compressor by the guide part, by aiming a target.

According to an eighth aspect of the invention, in the image forming apparatus according to any one of the second to seventh aspects, the guide part is made of a material that has a thermal conductivity lower than the thermal conductivity of the recording medium transport unit.

According to the image forming apparatus of the eighth aspect, since the guide part is made of a material has a low thermal conductivity, the heat loss of the secondary compressed gas can be reduced in the guide part. For this reason, since the secondary compressed gas, which is maintained at a low temperature, is blown to the peripheral surface of the recording medium transport unit from the gas compressor, the cooling efficiency of the recording medium transport unit can be further improved.

According to a ninth aspect of the invention, in the image forming apparatus according to any one of the first to eighth aspects, the recording medium transport unit is capable of holding the recording medium by receiving and winding the recording medium while rotating.

According to the image forming apparatus of the ninth aspect, the recording medium transport unit can hold a recording medium by receiving and winding the recording medium while rotating. Accordingly, the length, which has a long length, of the transport path of the recording medium in the rotation direction of the recording medium transport unit is obtained. For this reason, the size of the apparatus body can be reduced.

According to a tenth aspect of the invention, in the image forming apparatus according to any one of the first to ninth aspects, the gas compressor is connected to a compressed gas generating source that is provided outside the apparatus and supplies the primary compressed gas.

According to the image forming apparatus of the tenth aspect, since the compressed gas generating source, which supplies primary compressed gas, is provided outside the apparatus, only the gas compressor is provided in the apparatus. For this reason, the structure of an apparatus body is simplified and the size of the apparatus body can be reduced.

According to an eleventh aspect of the invention, in the image forming apparatus according to the tenth aspect, the compressed gas generating source is connected to a blower device that is provided outside the apparatus and discharges heat present in the apparatus to the outside, and is adapted to supply the primary compressed gas to the gas compressor in synchronization with an operation of the blower device.

According to the image forming apparatus of the eleventh aspect, since the primary compressed gas is supplied to the gas compressor from the compressed gas generating source in synchronization with the operation of the blower device, the apparatus body does not require control means for the supply of the primary compressed gas. For this reason, the structure of the apparatus body is simplified and the size of the apparatus body can be reduced.

According to a twelfth aspect of the invention, in the image forming apparatus according to any one of the first to eleventh aspects, the gas compressor is adapted to generate the secondary compressed gas from the primary compressed gas by a vortex effect.

According to the image forming apparatus of the twelfth aspect, the gas compressor can generate the secondary compressed gas, of which the temperature is low, from the primary compressed gas by using a vortex effect.

The invention has an excellent effect of obtaining an image forming apparatus that that can stably discharge liquid from a liquid discharge head and can be reduced in size by a simple structure.

DESCRIPTION OF THE PREFERRED EMBODIMENTS

First embodiment

An image forming apparatus according to a first embodiment of the invention will be described with reference to FIGS. 1 to 11.

(Entire Structure of Image Forming Apparatus)

Figure 1:
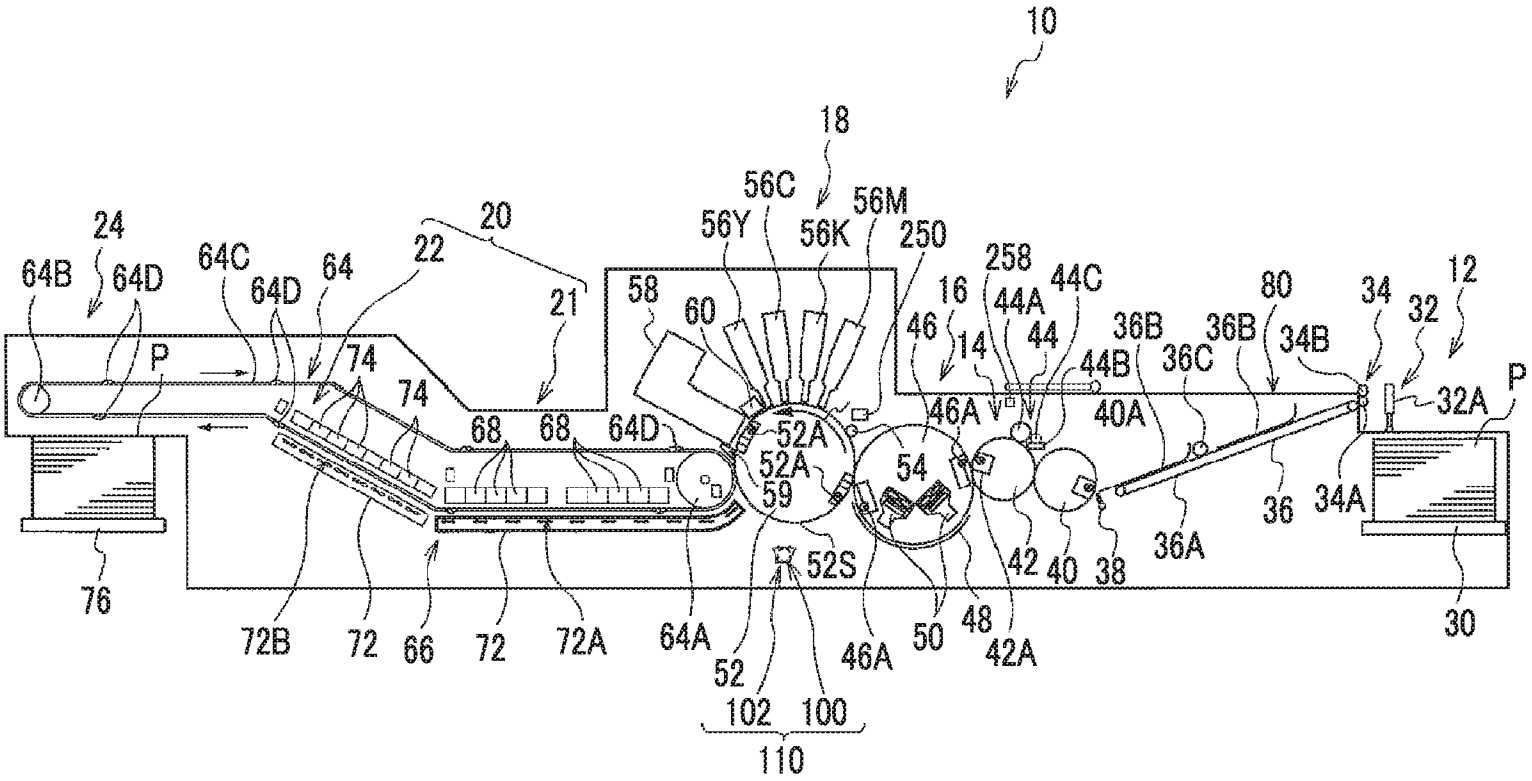
FIG. 1 is a schematic view showing the entire structure of an image forming apparatus according to a first embodiment of the invention.

As shown in FIG. 1, an image forming apparatus 10 according to this embodiment is adapted to form an image on a sheet-like recording medium (sheet) P with aqueous UV ink (ultraviolet curable ink using an aqueous medium) as photocurable ink by an ink jet method. The image forming apparatus 10 includes, a sheet feed section 12 that feeds a recording medium P, transport means for transporting a recording medium P, a treatment liquid applying section 14, a treatment liquid drying processing section 16, an image forming section 18, an ink fixing processing section 20 that includes a drying processing section 21 and a light irradiation section 22, control means (not shown) for controlling the entire system, and a sheet discharge section 24 that discharges a recording medium P, as main components.

1. Structure of Sheet Feed Section

The sheet feed section 12 is adapted to feed recording media P, which are loaded on a sheet feed tray 30, to the treatment liquid applying section 14 one by one. The sheet feed section 12 mainly includes a sheet feed tray 30, a sucker device 32, a pair of sheet feed rollers 34, a feeder board 36, a front stopper part 38, and a sheet feed drum 40.

Recording media P are placed on the sheet feed tray 30 in the form of a bundle in which a plurality of recording media are stacked. The sheet feed tray 30 can be moved up and down by a sheet feed tray lift (not shown). An operation for moving up and down the sheet feed tray is controlled in the sheet feed tray lift while being linked with an increase/decrease in the number of recording media P loaded on the sheet feed tray 30. In detail, the sheet feed tray is controlled so that the uppermost recording medium P of the bundle is always positioned at a constant height. The recording medium P is not particularly limited, but general-purpose printing sheets, which are used in general offset printing or the like, (sheets using cellulose as a main component, such as so-called high-quality paper, coated paper, and art paper) are used as the recording medium P.

In the sucker device 32, the recording media P loaded on the sheet feed tray 30 are lifted from the top one by one and are fed to the pair of sheet feed rollers 34. The sucker device 32 includes a suction foot 32A that is provided so as to freely move up and down and oscillate. The upper surface of a recording medium P is held by suction by the suction foot 32A, and the recording medium P is transferred to the pair of sheet feed rollers 34 from the sheet feed tray 30. In this case, the suction foot 32A is adapted to hold the upper surface of an end portion of the uppermost recording medium P of the bundle by suction, to lift the recording medium P, and to insert the end of the lifted recording medium P into the pair of sheet feed rollers 34.

The pair of sheet feed rollers 34 are formed of a pair of upper and lower rollers 34B and 34A that come into pressure contact with each other. One of the pair of upper and lower rollers 34B and 34A is used as a driving roller (for example, the roller 34A), and the other thereof is used as a driven roller (for example, the roller 34B). The driving roller is connected to a motor (not shown), and is driven and rotated by the drive of the motor. The motor is driven while being linked with the feeding of the recording medium P. When the recording medium P is fed from the sucker device 32, the motor rotates the driving roller at the time of the feeding of the recording medium P. The recording medium P, which is inserted into the pair of sheet feed rollers 34, is nipped and sent in an installation direction of the feeder board 36 by the pair of sheet feed rollers 34.

The feeder board 36 is formed so as to correspond to the transport width of the recording medium P and so as to have a width larger than the transport width, and is adapted to guide the recording medium P, which is sent from the pair of sheet feed rollers 34, to the front stopper part 38. The downstream portion of the feeder board 36 in a transport direction is inclined downward. For this reason, the recording medium P, which is positioned on a transport path on the feeder board 36, slides down on the transport path and is guided to the front stopper part 38.

A plurality of tape feeders 36A of which a longitudinal direction is parallel to the transport direction are installed in the feeder board 36 at intervals in a width direction intersecting the transport direction. The tape feeders 36A are adapted to transport a recording medium P. The tape feeders 36A are formed in the shape of an endless belt, and are adapted to use a motor (not shown) as a driving source and to transport a recording medium P by belts.

Further, retainers 36B and a roller 36C are installed on the feeder board 36. A plurality of retainers 36B are disposed along the transport path of the recording medium P. The retainers 36B are used as leaf springs that allow the recording medium P come into pressure contact with the tape feeders 36A. When the recording medium P, which is transported by the tape feeders 36A, passes through the retainers 36B, the irregularity of the recording medium P is corrected. The roller 36C is provided between the retainer 36B that is positioned on the upstream side in the transport direction and the retainer 36B that is positioned on the downstream side in the transport direction, and is adapted to press the recording medium P.

The front stopper part 38 is adapted to correct the posture of the recording medium P during the transport of the recording medium P. The front stopper part 38 is formed of a plate-like member that is orthogonal to the transport direction and comes into contact with the end of the recording medium P in the transport direction. Further, the front stopper part 38 is connected to a motor (not shown), and is driven by the motor so as to be capable of oscillating between the transport path and a non-transport path. The recording medium P of which the posture has been corrected during the transport thereof by the front stopper part 38 is delivered to the sheet feed drum 40.

The sheet feed drum 40 is adapted to transport the delivered recording medium P to the treatment liquid applying section 14. The sheet feed drum 40 is a cylindrical rotating body of which an axial direction is parallel to a direction orthogonal to the transport direction, and is adapted to be rotated by a motor (not shown). A gripper 40A is provided on the outer peripheral surface of the sheet feed drum 40, and an end of the recording medium P is gripped by the gripper 40A. The sheet feed drum 40 grips an end of the recording medium P by the gripper 40A and rotates. Accordingly, the sheet feed drum 40 transports the recording medium P to the treatment liquid applying section 14 while winding the recording medium P around the peripheral surface thereof.

2. Structure of Treatment Liquid Applying Section

The treatment liquid applying section 14 is adapted to apply predetermined treatment liquid to the surface (image forming surface) of the recording medium P. The treatment liquid applying section 14 mainly includes a treatment liquid applying drum 42 that transports a recording medium P, and a treatment liquid applying unit 44 that applies predetermined treatment liquid to the image forming surface of the recording medium P transported by the treatment liquid applying drum 42. The treatment liquid, which is applied to the surface of the recording medium P, is an aggregating agent having a function to allow a color material (pigment), which is contained in photocurable ink to be discharged (ejected) to the recording medium P in the image forming section 18 provided on the downstream side in the transport direction, to aggregate. Since photocurable ink is discharged after the treatment liquid is applied to the surface of the recording medium P, it is possible to form a high-quality image without causing landing interference and the like even though general-purpose printing sheets are used.

The treatment liquid applying drum 42 is a cylindrical rotating body of which an axial direction is parallel to the axial direction of the sheet feed drum 40, and is adapted to be rotated by a motor (not shown). A gripper 42A is provided on the outer peripheral surface of the treatment liquid applying drum 42, and an end of the recording medium P is gripped by the gripper 42A. The treatment liquid applying drum 42 grips an end of the recording medium P by the gripper 42A and rotates. Accordingly, the treatment liquid applying drum 42 transports the recording medium P to the treatment liquid drying processing section 16 while winding the recording medium P around the peripheral surface thereof. When the treatment liquid applying drum 42 makes one rotation, one recording medium P is transported. The rotation of the treatment liquid applying drum 42 and the rotation of the sheet feed drum 40 are controlled so that the time of the reception of the recording medium P and the time of the delivery of the recording medium P correspond to each other. That is, the treatment liquid applying drum 42 and the sheet feed drum 40 are driven so that the circumferential speed of the treatment liquid applying drum 42 and the circumferential speed of the sheet feed drum 40 are equal to each other, and are driven so that the positions of the grippers 40A and 42A of the treatment liquid applying drum 42 and the sheet feed drum 40 correspond to each other.

In the treatment liquid applying unit 44, treatment liquid is applied on the surface of the recording medium P transported by the treatment liquid applying drum 42. The treatment liquid applying unit 44 mainly includes: an applying roller 44A that applies treatment liquid to the recording medium P; a treatment liquid tank 44B in which treatment liquid is stored; and a scooping roller 44C that scoops treatment liquid, which is stored in the treatment liquid tank 44B, up and supplies the treatment liquid to the applying roller 44A.

Treatment liquid has been applied by the applying roller 44A in this embodiment, but a method of applying treatment liquid is not limited. An applying method using discharge heads having the same structure as ink discharge heads 56M, 56K, 56C, and 56Y of the image forming section 18 or an applying method using a spray can be used as the method of applying treatment liquid.

3. Structure of Treatment Liquid Drying Processing Section

The treatment liquid drying processing section 16 is adapted to dry the treatment liquid that is applied to the surface of the recording medium P. The treatment liquid drying processing section 16 mainly includes a treatment liquid drying processing drum 46 that transports a recording medium P, a sheet transport guide 48, and treatment liquid drying processing units 50 that dry treatment liquid by blowing dry air to the image forming surface of the recording medium P transported by the treatment liquid drying processing drum 46.

The treatment liquid drying processing drum 46 is adapted to receive a recording medium P from the treatment liquid applying drum 42 of the treatment liquid applying section 14 and to transport the recording medium P to the image forming section 18. The treatment liquid drying processing drum 46 is a cylindrical rotating body of which an axial direction is parallel to the axial direction of the treatment liquid applying drum 42, and is adapted to be rotated by a motor (not shown). Grippers 46A are provided on the outer peripheral surface of the treatment liquid drying processing drum 46, and ends of recording media P are gripped by the grippers 46A. The treatment liquid drying processing drum 46 grips the ends of the recording media P by the gripper 46A and rotates. Accordingly, the treatment liquid drying processing drum 46 transports the recording media P to the image forming section 18. Since the treatment liquid drying processing drum 46 of this embodiment includes the grippers 46A at two positions on the outer peripheral surface, the treatment liquid drying processing drum 46 is adapted to transport two recording media P during one rotation. The rotation of the treatment liquid drying processing drum 46 and the rotation of the treatment liquid applying drum 42 are controlled so that the time of the reception of the recording medium P and the time of the delivery of the recording medium P correspond to each other. That is, the treatment liquid drying processing drum 46 and the treatment liquid applying drum 42 are driven so that the circumferential speed of the treatment liquid drying processing drum 46 and the circumferential speed of the treatment liquid applying drum 42 are equal to each other, and are driven so that the positions of the grippers 46A and 42A of the treatment liquid drying processing drum 46 and the treatment liquid applying drum 42 correspond to each other.

The sheet transport guide 48 is provided along the transport path of the recording medium P so as to face the outer peripheral surface of the treatment liquid drying processing drum 46. The sheet transport guide 48 is adapted to guide the recording medium P so that the recording medium P does not deviate from the treatment liquid drying processing drum 46 (transport path).

The treatment liquid drying processing units 50 are provided inside the treatment liquid drying processing drum 46, and are adapted to perform drying processing by blowing dry air to the surface of the recording medium P transported by the treatment liquid drying processing drum 46. Accordingly, a solvent component contained in the treatment liquid is removed, so that an ink aggregation layer is formed on the surface of the recording medium P. In this embodiment, two treatment liquid drying processing units 50 are provided in the treatment liquid drying processing drum 46.

4. Structure of Image Forming Section

The image forming section 18 is adapted to form (print, record, or draw) a color or monochrome image on the image forming surface of the recording medium P by discharging liquid droplets of photocurable ink having colors of magenta (M), black (K), cyan (C), and yellow (Y) to the image forming surface of the recording medium P. The image forming section 18 mainly includes an image forming drum 52 serving as a recording medium transport unit, a recording medium pressing roller 54, ink discharge heads 56M, 56K, 56C, and 56Y serving as a liquid discharge head, an in-line sensor 58, and a mist filter 60. Ink having a magenta color is discharged from the ink discharge head 56M. Ink having a black color is discharged from the ink discharge head 56K, ink having a cyan color is discharged from the ink discharge head 56C, and ink having a yellow color is discharged from the ink discharge head 56Y. Photocurable ink is used as the ink discharged from each of the ink discharge heads 56M, 56K, 56C, and 56Y as described above. The photocurable ink is cured by being irradiated with light (here, ultraviolet light) after being discharged.

Figure 4:
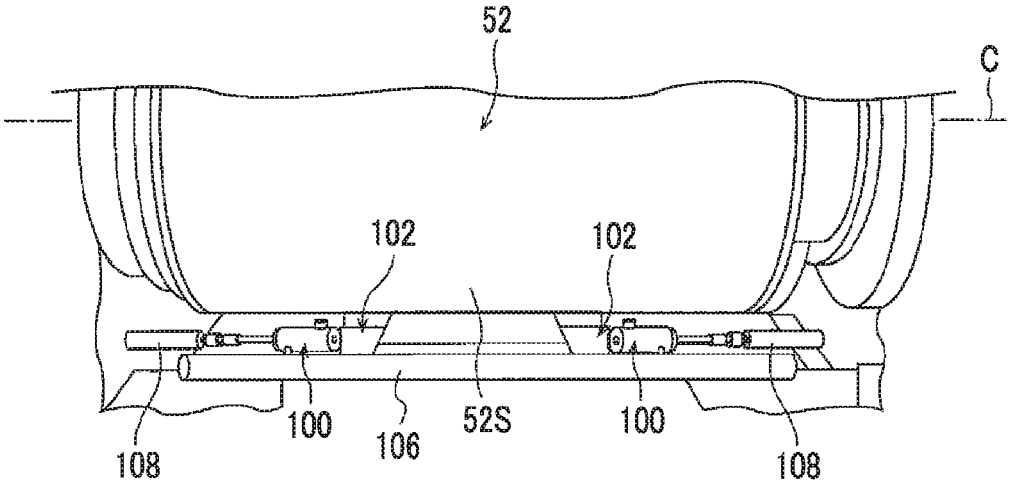
FIG. 4 is a perspective view of main parts of an image forming drum and gas compressors of the image forming apparatus shown in FIG. 1 seen from the downstream side in a transport direction of a recording medium.
Figure 5:
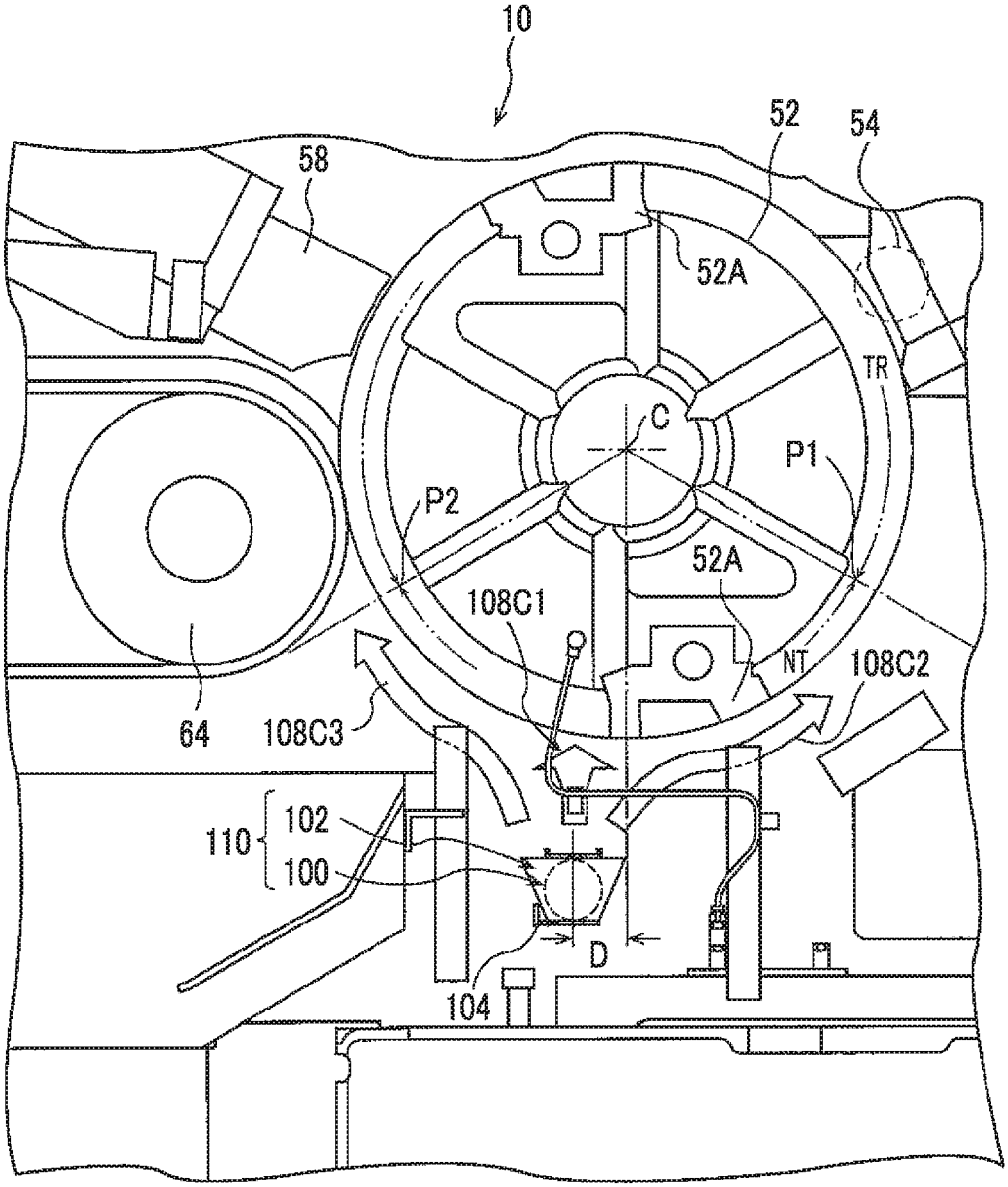
FIG. 5 is an enlarged view of main parts of the image forming drum and a drying processing unit of the image forming apparatus shown in FIG. 1 seen from the side orthogonal to the transport direction.

The image forming drum 52 is adapted to rotate to receive the recording medium P from the treatment liquid drying processing drum 46 of the treatment liquid drying processing section 16, to be capable of holding the recording medium P on the outer peripheral portion thereof, and to be capable of transporting the recording medium P to the ink fixing processing section 20. As shown in FIGS. 4 and 5, the image forming drum 52 is a cylindrical rotating body of which a direction of a rotation axis C is parallel to the axial direction of the treatment liquid drying processing drum 46, and is adapted to be rotated by a motor (not shown). As shown in FIGS. 1 and 5, grippers 52A are provided on the outer peripheral surface of the image forming drum 52 and ends of recording media P are gripped by the grippers 52A. The image forming drum 52 grips the ends of the recording media P by the gripper 52A and rotates. Accordingly, the image forming drum 52 transports the recording media P to the ink fixing processing section 20 while winding the recording media P around the peripheral surface thereof.

Here, as shown in FIG. 5, the peripheral surface (outer peripheral portion) of the image forming drum 52, which extends in a counterclockwise direction from the treatment liquid drying processing section 16 positioned on one side of the rotation axis C (that is, the upstream side in the transport direction) to the ink fixing processing section 20 positioned on the other side of the rotation axis C (that is, the downstream side in the transport direction), is used as a transport range TR for the recording medium P. In detail, a range between the position, which is denoted by reference numeral P1, and the position, which is denoted by reference numeral P2, in a counterclockwise direction in FIG. 5 is used as the transport range TR that is a part of the image forming drum in a circumferential direction. Further, a range on the peripheral surface between the position P2 and the position P1 in the counterclockwise direction (the other portion of the peripheral surface in the circumferential direction) is used as a non-transport range NT in which the transport of the recording medium P is not performed. That is, the non-transport range NT is a range that deviates from the transport range TR on the outer peripheral portion of the image forming drum 52 in the circumferential direction and is positioned outside the transport range TR. As shown in FIG. 4, the peripheral surface of the image forming drum 52 as the non-transport range NT is denoted by reference numeral 52S. That is, two thirds of the upper portion of the image forming drum 52 is used as the transport range TR, and one third of the lower portion thereof is used as the non-transport range NT. Accordingly, while rotating, the image forming drum 52 receives the recording medium P from the treatment liquid drying processing drum 46 at the position P1, which is the starting point of the transport range TR, and winds the recording medium P around the peripheral surface thereof by the rotation thereof. Then, while rotating, the image forming drum 52 transports the recording medium P and delivers the recording medium P to the ink fixing processing section 20 at the position P2 that is the end point of the transport range TR.

Further, a plurality of suction holes (not shown) are formed in a predetermined pattern on the peripheral surface of the image forming drum 52. Since the recording medium P, which is wound around the peripheral surface of the image forming drum 52, is sucked through the suction holes, the recording medium P can be transported while being held on the peripheral surface of the image forming drum 52 by suction. Accordingly, the recording medium P can be transported with high smoothness. Suction from the suction holes is performed on the transport path TR. Furthermore, a method of holding the recording medium P is not limited to a suction method using negative pressure, and an attraction method using static electricity may be used.

Moreover, since the grippers 52A are provided at two positions on the outer peripheral surface of the image forming drum 52 of this embodiment as in the case of the treatment liquid drying processing drum 46, the image forming drum 52 can transport two recording media P during one rotation. The rotation of the image forming drum 52 and the rotation of the treatment liquid drying processing drum 46 are controlled so that the time of the reception of the recording medium P and the time of the delivery of the recording medium P correspond to each other. That is, the image forming drum 52 and the treatment liquid drying processing drum 46 shown in FIG. 1 are driven so that the circumferential speed of the image forming drum 52 and the circumferential speed of the treatment liquid drying processing drum 46 are equal to each other, and are driven so that the positions of the grippers 52A and 46A of the image forming drum 52 and the treatment liquid drying processing drum 46 correspond to each other.

As shown in FIGS. 1 and 5, the recording medium pressing roller 54 is provided near a receiving position of the recording medium P on the image forming drum 52 (the position P1 at which the image forming drum 52 receives the recording medium P from the treatment liquid drying processing drum 46). The recording medium pressing roller 54 is formed of, for example, a rubber roller and is adapted to come into pressure contact with the peripheral surface of the image forming drum 52. The recording medium P, which is delivered to the image forming drum 52 from the treatment liquid drying processing drum 46, is nipped by passing through the recording medium pressing roller 54 and comes into close contact with the peripheral surface of the image forming drum 52.

In this embodiment, the ink discharge heads 56M, 56K, 56C, and 56Y are provided so as to face the peripheral surface of the image forming drum 52 and are disposed along the transport path of the recording medium P at regular intervals. Each of the ink discharge heads 56M, 56K, 56C, and 56Y is formed of a line head having a length corresponding to the width of the recording medium P. Each of the ink discharge heads 56M, 56K, 56C, and 56Y is adapted to discharge liquid droplets of photocurable ink to the image forming drum 52 from a nozzle array formed on a nozzle surface, and an image is formed using the photocurable ink that is discharged to the recording medium P transported by the image forming drum 52.

The in-line sensor 58 is provided on the downstream side of the rearmost ink discharge head 56Y in the transport direction so as to face the peripheral surface of the image forming drum 52. The in-line sensor 58 is adapted to read the image that is formed by the ink discharge heads 56M, 56K, 56C, and 56Y. For example, a line scanner is used as the in-line sensor 58.

A contact prevention plate 59, which is installed close to the in-line sensor 58, is provided on the downstream side of the in-line sensor 58 in the transport direction. The contact prevention plate 59 can prevent the recording medium P from coming into contact with the in-line sensor 58 in a case in which the recording medium P floats or is folded due to a transport failure or the like.

The mist filter 60 is provided between the rearmost ink discharge head 56Y and the in-line sensor 58, and is adapted to suck air around the image forming drum 52 and to catch ink mist. When ink mist is caught, it is possible to prevent the ink mist from entering the in-line sensor 58. Accordingly, it is possible to effectively prevent the occurrence of an error in reading the image and the like.

5. Structure of Cooling Unit

As shown in FIG. 1, a cooling unit 110 is provided in the image forming section 18 so as to face the peripheral surface 52S of the lower portion of the image forming drum 52. The peripheral surface 52S is the peripheral surface of a range, which is positioned on the peripheral surface of the image forming drum 52, deviates from the transport range TR of the image forming drum 52 in the circumferential direction by the rotation of the image forming drum 52, and is positioned outside the transport range TR, that is, the non-transport range NT. The cooling unit 110 mainly includes gas compressors 100 and guide parts 102. The gas compressors 100 are adapted to blow secondary compressed gas (108C), of which the temperature is lower than the temperature of primary compressed gas, from the primary compressed gas (106C) that is supplied from the outside of the image forming apparatus 10. The guide parts 102 are adapted to guide the secondary compressed gas, which is blown from the gas compressors 100, to the peripheral surface 52S of the image forming drum 52 and to diffuse the secondary compressed gas along the direction of the rotation axis C of at least the image forming drum 52. That is, the cooling unit 110 is adapted to blow the secondary compressed gas, which is blown from the gas compressors 100, to the peripheral surface 52S of the image forming drum 52, which is being rotated, through the guide parts 102. The detailed structure of the gas compressor 100 and the guide part 102 will be described below.

6. Structure of Ink Fixing Processing Section

The ink fixing processing section 20 is adapted to remove a liquid component remaining on the image forming surface of the recording medium P and to perform the aftertreatment of the recording medium P on which the image has been formed. The ink fixing processing section 20 mainly includes a chain gripper 64 that transports the recording medium P on which the image has been recorded, a back tension applying mechanism 66 that applies back tension to the recording medium P transported by the chain gripper 64, and a drying processing section 21 and a light irradiation section 22 as ink fixing means for performing processing for fixing the image to the recording medium P that is transported by the chain gripper 64.

The chain gripper 64 is a transport mechanism that is used in common to the drying processing section 21, the light irradiation section 22, and the sheet discharge section 24, and is adapted to receive the recording medium P delivered from the image forming section 18 and to transport the recording medium P to the sheet discharge section 24.

The chain gripper 64 mainly includes first sprockets 64A that are installed close to the image forming drum 52, second sprockets 64B that are installed close to the sheet discharge section 24, chains 64C as an endless transport path that is wound around the first and second sprockets 64A and 64B, a plurality of chain guides (not shown) that guide the travel of the chains 64C, and a plurality of grippers 64D that are mounted on the chains 64C at regular intervals. Each of the first sprockets 64A, the second sprockets 64B, the chains 64C, and the chain guides are provided on both sides of the recording medium P in a transport width direction so as to make a pair. The grippers 64D are provided on each of the pair of chains 64C. The first sprockets 64A are connected to a motor (not shown), and are driven by the drive of the motor. The second sprockets 64B are adapted to be rotated by the rotation of the first sprockets 64A.

The back tension applying mechanism 66 is adapted to apply back tension to the recording medium P that is transported while the end of the recording medium P is gripped by the chain gripper 64. The back tension applying mechanism 66 mainly includes a guide plate 72, and a plurality of suction fans 72A that suck air from a plurality of suction holes formed in the guide plate 72. Further, a plurality of exhaust holes through which the sucked air is discharged are provided on the lower surface of the guide plate 72. When air is sucked by the suction fans 72A through the suction holes of the guide plate 72, back tension is applied to the recording medium P transported by the chain gripper 64.

(1) Structure of Drying Processing Section

The drying processing section 21 includes a plurality of drying processing units 68 that are provided in the chain gripper 64 on the upstream side of the chain gripper 64 in the transport direction. The plurality of drying processing units 68 are arranged along the transport direction. The drying processing units 68 are adapted to blow dry air (for example, hot air) to the image forming surface of the recording medium P. When dry air is blown by the drying processing units 68, the amount of moisture contained in the photocurable ink can be reduced before the photocurable ink is irradiated with light (ultraviolet light) by the light irradiation section 22. Accordingly, the curability of the photocurable ink can be ensured when the image is subsequently irradiated with light.

(2) Structure of Light Irradiation Section

The light irradiation section 22 is adapted to irradiate the image, which is formed using the photocurable ink, with ultraviolet light (UV) serving as light in this embodiment and to fix the image. The light irradiation section 22 mainly includes the chain gripper 64, the back tension applying mechanism 66, and irradiation units 74 that irradiate the recording medium P with light.

The irradiation units 74 are provided in the chain gripper 64 on the downstream side of the drying processing section 21 in the transport direction. A plurality of irradiation units 74 are arranged along the transport direction. Each irradiation unit 74 includes an ultraviolet lamp (not shown) as a light source. The back tension applying mechanism 66 mainly includes the guide plate 72, and the plurality of suction fans 72B that suck air from a plurality of suction holes formed in the guide plate 72. Further, a plurality of holes through which the sucked air is discharged are provided on the lower surface of the guide plate 72. When air is sucked by the suction fans 72B through the suction holes of the guide plate 72, back tension is applied to the recording medium P transported by the chain gripper 64. Since the height of the sheet discharge section 24, which is provided on the downstream side in the transport direction, is greater than the height of the drying processing section 21, a transport position is adjusted at the light irradiation section 22. In more detail, components, such as the chain gripper 64 and the guide plate 72, of the light irradiation section 22 are inclined upward from the lower side toward the downstream side in the transport direction.

7. Structure of Sheet Discharge Section

The sheet discharge section 24 is adapted to collect recording media P on which a series of image forming processing has been formed. The sheet discharge section 24 mainly includes the chain gripper 64 that transports the recording media P to which the photocurable ink has been fixed by being irradiated with light, and a sheet discharge tray 76 that collects the recording media P so that the recording media P are stacked. The sheet discharge tray 76 is provided with sheet stoppers (not shown) (a front sheet stopper, a rear sheet stopper, a lateral sheet stopper, and the like) that orderly stack the recording media P. Further, the sheet discharge tray 76 is provided with a sheet discharge tray lift (not shown) that can lift that can move up and down the recording media P. The drive of the upward and downward movement of the sheet discharge tray lift is controlled while being linked with an increase/decrease in the number of recording media P collected in the sheet discharge tray 76 so that the uppermost recording medium P is adjusted to be always positioned at a constant height.

8. Photocurable Ink

Here, for example, aqueous ultraviolet curable ink, which is cured by being irradiated with ultraviolet light serving as light, is used as the photocurable ink of this embodiment. It is preferable that the aqueous ultraviolet curable ink contains a pigment, polymer particles, a water-soluble polymerizable compound polymerized by an active energy ray, and a photopolymerization initiator. Since the aqueous ultraviolet curable ink is excellent in the rub resistance of an image when the aqueous ultraviolet curable ink is cured by being irradiated with ultraviolet light, the film hardness of the image can be increased. A dye may also be contained in the aqueous ultraviolet curable ink as the color material.

Figure 2:
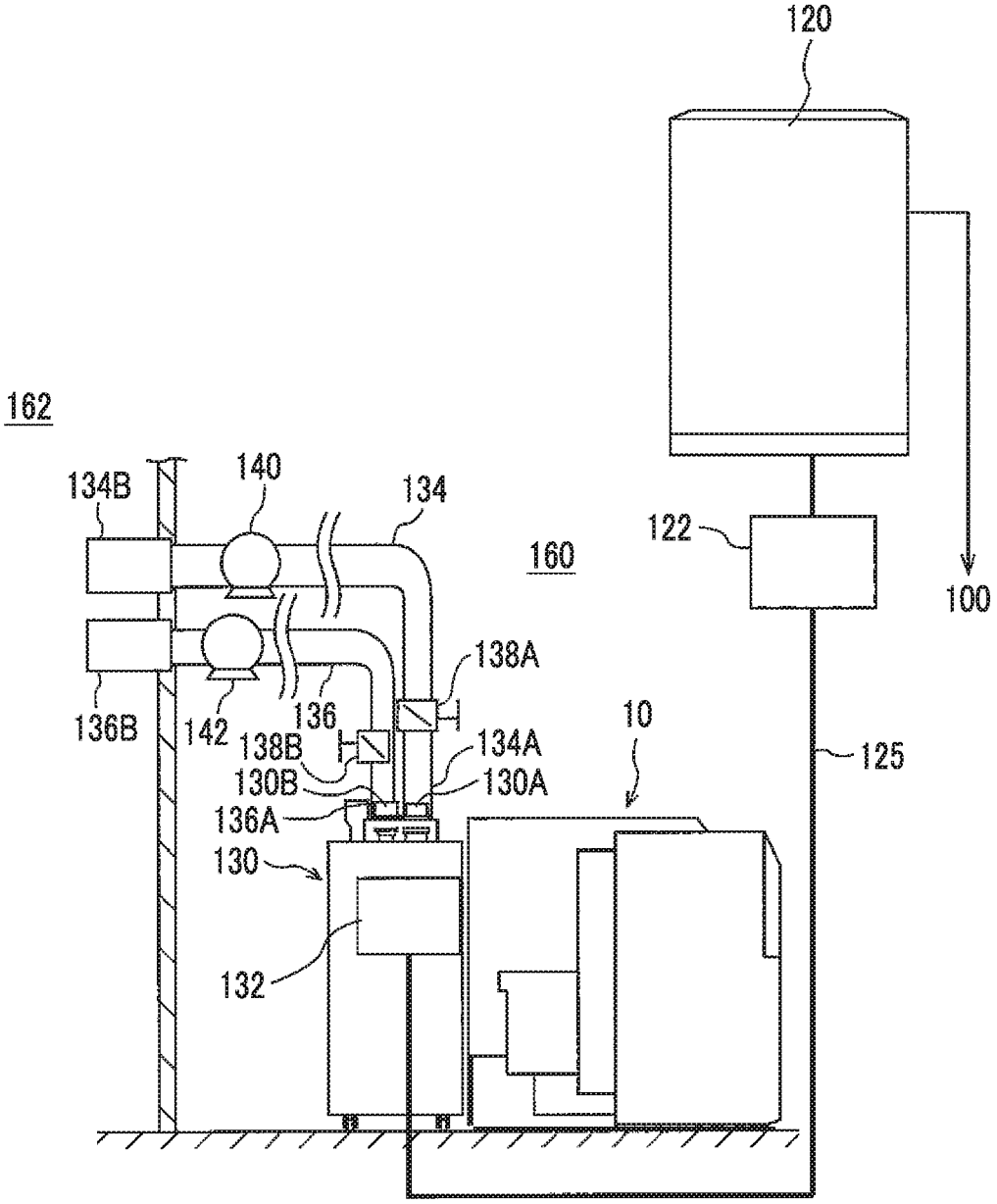
FIG. 2 is a system configuration diagram of the image forming apparatus, a compressed gas generating source, and an air station including a blower device shown in FIG. 1.

(Structure of Compressed Gas Generating Source) As shown in FIG. 2, a compressed gas generating source 120 is provided in a room 160, in which the image forming apparatus 10 is installed, as an external device of the image forming apparatus 10. The compressed gas generating source 120 is a compressor that generates the primary compressed gas 106C (see FIGS. 6 and 7, and the like) by compressing gas. In this embodiment, the primary compressed gas 106C is compressed air that is generated by compressing air. The primary compressed gas 106C is supplied to the gas compressors 100 shown in FIG. 1. Any one of a compressor that is installed for only the image forming apparatus 10, a compressor that also supplies compressed air to other devices of the image forming apparatus 10, and a compressor that is built as a facility in the room 160 in which the image forming apparatus 10 is installed may be used as the compressed gas generating source 120. A control device 122, which controls the operation of the compressed gas generating source 120, is connected to the compressed gas generating source 120.

(Air Station and Blower Device)

As shown in FIG. 2, an air station 130 serving as an external device of the image forming apparatus 10 is provided on the back side of the image forming apparatus 10 in the room 160. The air station 130 is adapted to discharge heat, which is generated in the apparatus by an image forming operation of the image forming apparatus 10, to the outside 162. Further, the air station 130 is adapted to also discharge heat, which is generated by a gas compressing operation of the compressed gas generating source 120, to the outside 162.

Exhaust ports 130A and 130B are provided at the upper portion of the air station 130. The exhaust port 130A is connected to the compressed gas generating source 120. A connecting portion 134A, which is provided at one end of an exhaust duct 134, is connected to the exhaust port 130A, and an outdoor exhaust port 134B, which is provided at the other end of the exhaust duct 134, is installed on the outside 162. An on-off valve 138A and an exhaust fan 140 are provided on the exhaust duct 134 in this order from the exhaust port 130A toward the outside 162. The exhaust fan 140 is adapted to forcibly discharge heat, which is recovered in the body of the air station 130, to the outside 162.

The exhaust port 130B is connected to the image forming apparatus 10. A connecting portion 136A, which is provided at one end of an exhaust duct 136, is connected to the exhaust port 130B, and an outdoor exhaust port 136B, which is provided at the other end of the exhaust duct 136, is installed on the outside 162. An on-off valve 138B and a blower device 142 are provided on the exhaust duct 136 in this order from the exhaust port 130B toward the outside 162. The blower device 142 is adapted to forcibly discharge heat, which is recovered in the body of the air station 130, to the outside 162. A control device 132, which controls the operation of the air station 130, is connected to the air station 130.

(Structure of Control Device)

Figure 3:
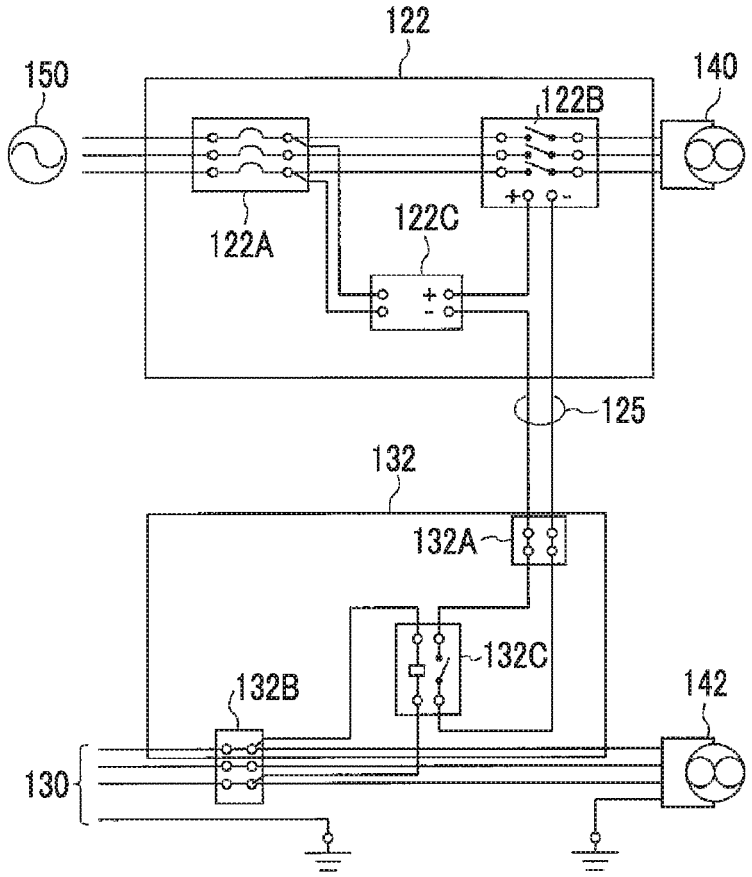
FIG. 3 is a wiring diagram of control devices of the compressed gas generating source and the air station shown in FIG. 2.

As shown in FIG. 3, the control device 122 of the compressed gas generating source 120 mainly includes an earth leakage circuit breaker 122A, an electromagnetic switch 122B, and a switching power supply 122C. The earth leakage circuit breaker 122A is connected to an external power supply 150. The external power supply 150 corresponds to three-phase AC 200 V. The switching power supply 122C is connected to the earth leakage circuit breaker 122A. The electromagnetic switch 122B is connected to the earth leakage circuit breaker 122A and the switching power supply 122C. Further, the electromagnetic switch 122B is connected to the exhaust fan 140, and the operation of the exhaust fan 140 is started when the electromagnetic switch 122B is turned on.

The control device 132 of the air station 130 mainly includes terminal blocks 132A and 132B and a relay 132C. The terminal block 132B is connected to the air station 130, and is also connected to the blower device 142. The terminal block 132A is connected to the electromagnetic switch 122B and the switching power supply 122C of the control device 122 of the compressed gas generating source 120 through wires 125. The relay 132C is connected to the terminal blocks 132A and 132B.

In more detail, the control device 122 of the compressed gas generating source 120 and the control device 132 of the air station 130 are connected to each other in this embodiment. Further, when the blower device 142 of the air station 130 is operated, the compressed gas generating source 120 is operated through the relay 132C and the switching power supply 122C. That is, the compressed gas generating source 120 generates the primary compressed gas 106C in synchronization with (while being linked with) the operation of the blower device 142, and the primary compressed gas 106C is supplied to the gas compressor 100 from the compressed gas generating source 120 (see FIGS. 6 and 7).

(Structure of Gas Compressor of Cooling Unit)

As shown in FIGS. 4 and 5, the gas compressor 100 of the cooling unit 110 of the image forming apparatus 10 shown in FIG. 1 is provided immediately below the image forming drum 52 so as to face the peripheral surface 52S. In detail, as shown in FIG. 4, two gas compressors 100 are provided along the direction of the rotation axis C of the image forming drum 52 in this embodiment. One gas compressor 100 cools one side (the left side in FIG. 4) of the image forming drum 52 in the direction of the rotation axis C, and the other gas compressor 100 cools the other side (the right side in FIG. 4) of the image forming drum 52 in the direction of the rotation axis C. In this embodiment, the two gas compressors 100 are disposed so that the positions of the two gas compressors 100 in the transport direction correspond to each other. When each gas compressor 100 is provided immediately below the image forming drum 52 on a line perpendicular to the rotation axis C so as to face the image forming drum 52, a distance between the gas compressor 100 and the peripheral surface 52S can be set to be shortest. Accordingly, in terms of the improvement of cooling efficiency, it is preferable that each gas compressor 100 is provided immediately below the image forming drum 52 on a line perpendicular to the rotation axis C so as to face the image forming drum 52. In this embodiment, as shown in FIG. 5, each gas compressor 100 is provided so as to deviate by a distance D toward the drying processing section 21 provided on the downstream side of a position, which is present immediately below the image forming drum 52, (the line perpendicular to the rotation axis) in the transport direction. The distance D is smaller than the radius of the image forming drum 52, and is in the range of several centimeters to several tens of centimeters here.

Figure 6:
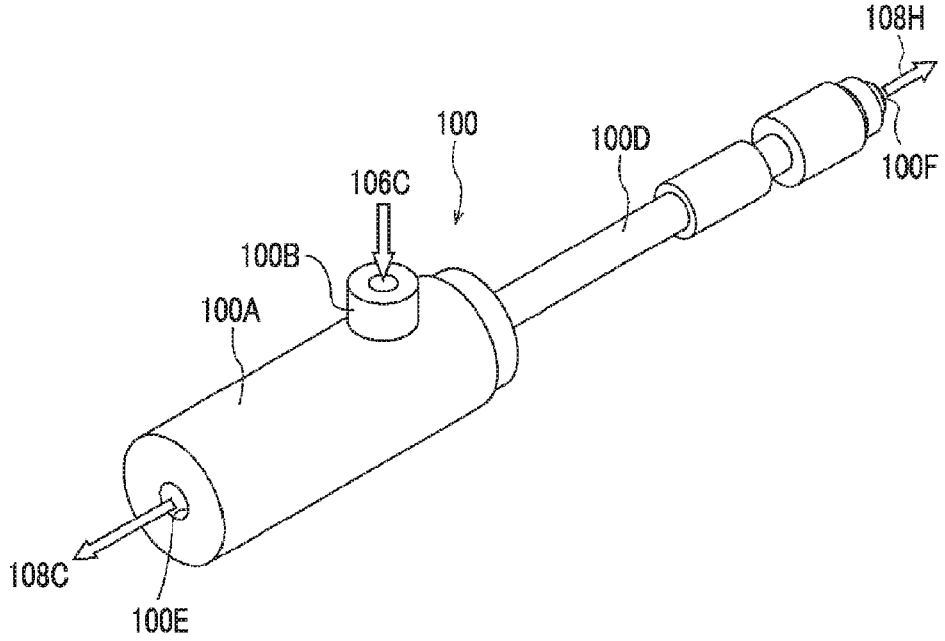
FIG. 6 is an enlarged perspective view of the gas compressor shown in FIG. 4.
Figure 7:
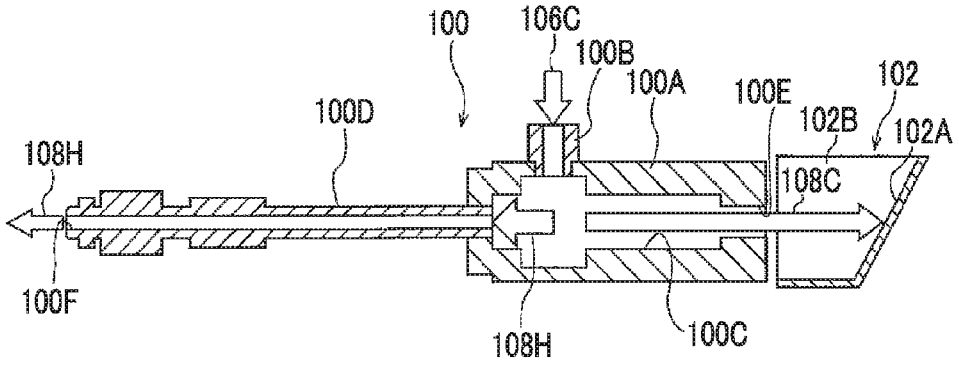
FIG. 7 is a sectional view of the gas compressor and a guide part shown in FIG. 6 taken along an axial direction.

As shown in FIGS. 6 and 7, each gas compressor 100 includes a cylindrical compressing part 100A of which an axial direction is parallel to the direction of the rotation axis C of the image forming drum 52 and which has an internal space 100C. A cylindrical supply port 100B, which is connected to the compressed gas generating source 120 and through which the primary compressed gas 106C is supplied to the internal space 100C from the compressed gas generating source 120, is provided on the peripheral surface of the compressing part 100A. The primary compressed gas 106C, which is supplied from the compressed gas generating source 120, is supplied to the supply port 100B through a supply pipe part 106 (see FIG. 4). A cylindrical warm air-exhaust pipe part 100D of which the diameter is smaller than the diameter of the compressing part 100A is connected to one end of the compressing part 100A in the axial direction so that the axial direction of the warm air-exhaust pipe part 100D corresponds to the axial direction of the compressing part 100A. A warm air outlet 100F is provided on the side of the warm air-exhaust pipe part 100D opposite to the compressing part 100A. The warm air outlet 100F is adapted to blow warm air that is generated when the secondary compressed gas 108C is formed. On the other hand, a cold air outlet 100E serving as an outlet is provided on the side of the compressing part 100A opposite to the warm air-exhaust pipe part 100D. The diameter of the cold air outlet 100E is smaller than the inner diameter of the internal space 100C and the cold air outlet 100E blows the secondary compressed gas 108C, of which the temperature is lower than the temperature of the primary compressed gas 106C, along the direction of the rotation axis C of the image forming drum 52. As shown in FIG. 5, the gas compressors 100 and the guide parts 102 are mounted on the housing of the image forming apparatus 10 by a mounting bracket 104.

In each gas compressor 100, the secondary compressed gas 108C is formed from the primary compressed gas 106C by a vortex effect. In detail, first, the primary compressed gas 106C, which is generated by the compressed gas generating source 120, is supplied first to the internal space 100C from the supply port 100B as shown in FIG. 7. In the internal space 100C, the primary compressed gas 106C is generated as warm air by adiabatic expansion and the warm air is blown (heat is discharged) from the warm air outlet 100F through the warm air-exhaust pipe part 100D. On the other hand, since warm air is blown, cold air is generated. The cold air is blown from the cold air outlet 100E as the secondary compressed gas 108C.

(Structure of Guide Part of Cooling Unit)

As shown in FIGS. 4, 5, 7, 8A, 8B, and 8C, the guide part 102 is adapted to guide the secondary compressed gas 108C, which is blown from the cold air outlet 100E of the gas compressor 100, to the peripheral surface 52S of the image forming drum 52 and to diffuse the secondary compressed gas 108C. In detail, the guide part 102 includes a guide plate 102A that guides the flow of the secondary compressed gas 108C blown along the rotation axis C so that the flow of the secondary compressed gas 108C is changed to secondary compressed gas 108C1 flowing toward the peripheral surface 52S of the image forming drum 52 as particularly shown in FIGS. 8A and 8B. In this embodiment, an interior angle α between the surface of the guide plate 102A facing the peripheral surface 52S and the rotation axis C is set in the range of 30° to 50° when seen from the downstream side in the transport direction. Further, in this embodiment, the guide plate 102A is provided so that the width direction of the guide plate 102A corresponds to a horizontal direction. The width direction of the guide plate 102A may be set at a right angle to a normal that extends perpendicular to the peripheral surface 52S of the image forming drum 52.

Figure 8A:
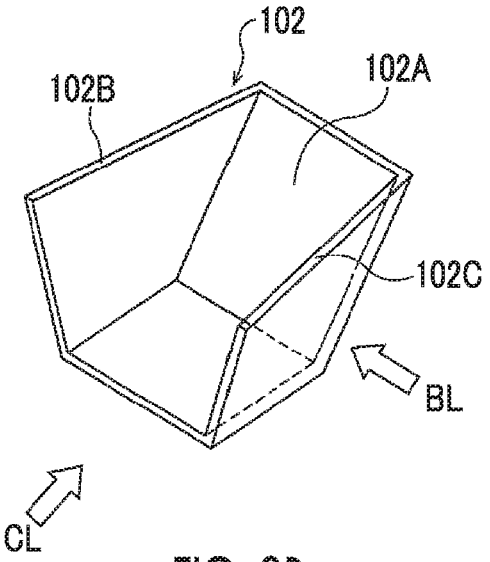
FIG. 8A is a perspective view of the guide part shown in FIG. 7.
Figure 8B:
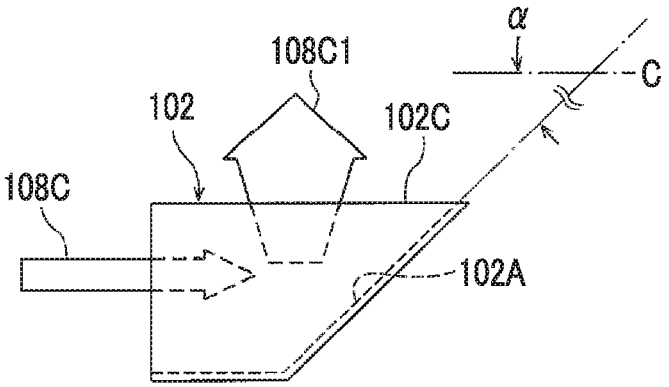
FIG. 8B is a side view of the guide part shown in FIG. 8A seen in a direction of an arrow BL.
Figure 8C:
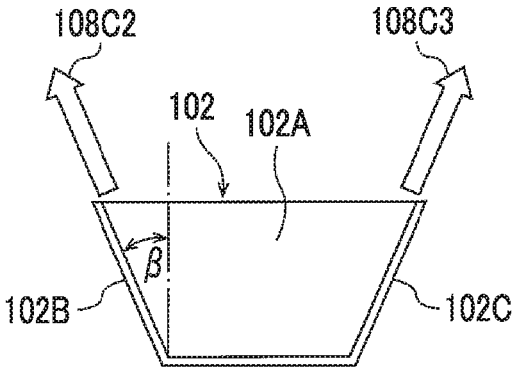
FIG. 8C is a front view of the guide part shown in FIG. 8A seen in a direction of an arrow CL.

Furthermore, as shown in FIGS. 8A and 8C, guide walls 102B and 102C stand at both end portions of the guide plate 102A that correspond to the upstream side and the downstream side in the transport direction, respectively. As shown in FIGS. 5 and 8C, the guide wall 102B corresponding to the upstream side in the transport direction is adapted to guide the secondary compressed gas 108C so that the secondary compressed gas 108C is changed to secondary compressed gas 108C2 flowing in the circumferential direction of a portion of the image forming drum 52 close to the treatment liquid drying processing section 16. The guide wall 102C corresponding to the downstream side in the transport direction is adapted to guide the secondary compressed gas 108C so that the secondary compressed gas 108C is changed to secondary compressed gas 108C3 flowing in the circumferential direction of a portion of the image forming drum 52 close to the drying processing section 21. The guide wall 102B is inclined with respect to a vertical line to the upstream side in the transport direction by an angle β. Likewise, the guide wall 102C is inclined with respect to a vertical line to the downstream side in the transport direction by an angle β. The angle βis in the range of 20° to 40° , and the angle βis set to 30° in this embodiment.

The guide plate 102A of the guide part 102 is integrally formed with the guide walls 102B and 102C. Further, the guide part 102 is made of a material that has a thermal conductivity lower than the thermal conductivity of the image forming drum 52. Specifically, the guide part 102 is made of a resin material.

(Action and Effect of This Embodiment)

In the image forming apparatus 10 according to this embodiment, as shown in FIGS. 1 and 5, the image forming drum 52 can hold a recording medium P on the outer peripheral portion thereof and the recording medium P can be transported from one side of the rotation axis C to the other side thereof when the image forming drum 52 is rotated. The ink discharge heads 56M, 56K, 56C, and 56Y are provided in the transport range TR, in which the image forming drum 52 transports a recording medium P, so as to face the outer peripheral portion of the image forming drum 52. The ink discharge heads 56M, 56K, 56C, and 56Y can form an image by discharging ink to the recording medium P that can be transported by the image forming drum 52. On the other hand, the secondary compressed gas 108C is blown from the gas compressors 100 to the peripheral surface 52S, which corresponds to a range positioned outside the transport range TR (the non-transport range NT) and deviating from the transport range TR in the circumferential direction, of the outer peripheral portion of the image forming drum 52.

Here, since the secondary compressed gas 108C of which the temperature is low is blown to the peripheral surface 52S of the image forming drum 52, which correspond to the non-transport range NT, from the gas compressors 100 shown in FIGS. 4 to 7, the image forming drum 52 can be cooled. In the image forming apparatus 10 according to this embodiment, the temperature of ink discharged from the ink discharge heads 56M, 56K, 56C, and 56Y is adjusted to a constant temperature. For example, the temperature of the ink is adjusted to 30° C. higher than the room temperature. In contrast, when the temperature of the image forming drum 52 rises to, for example, 32° C., the evaporation of the moisture contained in the recording medium P, the treatment liquid, ink, and the like is facilitated. As a result, dew condensation occurs on the nozzle surfaces of the ink discharge heads 56M, 56K, 56C, and 56Y. Particularly, in continuous short run print in which a small lot job is continuously performed at a short interval of, for example, about 30 seconds, a heat generating source, such as the drying processing section 21, is operating even in the interval. For this reason, a rise in the temperature of the image forming drum 52 cannot be avoided. The peripheral surface 52S of the image forming drum 52 can be cooled down to 30° C. or less, that is, 20° C. or less as described below by the secondary compressed gas 108C that is blown from the gas compressors 100 of this embodiment. For this reason, the occurrence of dew condensation on the ink discharge heads 56M, 56K, 56C, and 56Y can be effectively suppressed.

As shown in FIGS. 1 and 2, the image forming apparatus 10 is adapted so that primary compressed gas 106C is supplied to the gas compressors 100 from the outside of the apparatus. Accordingly, since the gas compressors 100 are provided in the apparatus, the compressed gas generating source 120, which generates the primary compressed gas 106C, is not provided in the apparatus. In addition, since the gas compressor 100 generate the secondary compressed gas 108C, of which the temperature is low, from the primary compressed gas 106C as shown in FIG. 7, the structure of the gas compressor 100 is simplified and the size of the gas compressor 100 can be reduced.

Accordingly, according to the image forming apparatus 10 of this embodiment, it is possible to stably discharge ink from the ink discharge heads 56M, 56K, 56C, and 56Y and to reduce the size of the image forming apparatus by a simple structure.

Further, in the image forming apparatus 10 according to this embodiment, the secondary compressed gas 108C is blown from the cold air outlet 100E of the gas compressors 100 along the direction of the rotation axis C of the image forming drum 52 as shown in FIGS. 4 to 7 and FIG. 8A. The secondary compressed gas 108C is guided from the direction of the rotation axis C toward the peripheral surface 52S of the image forming drum 52 by the guide part 102, and is diffused along the direction of the rotation axis C. For this reason, since the length of the flow passage of the secondary compressed gas 108C to the peripheral surface 52S of the image forming drum 52 from the cold air outlet 100E is increased using the direction of the rotation axis C, it is possible to widely diffuse the secondary compressed gas 108C, which is to be blown to the peripheral surface 52S of the image forming drum 52, along the direction of the rotation axis C.

Figure 9:
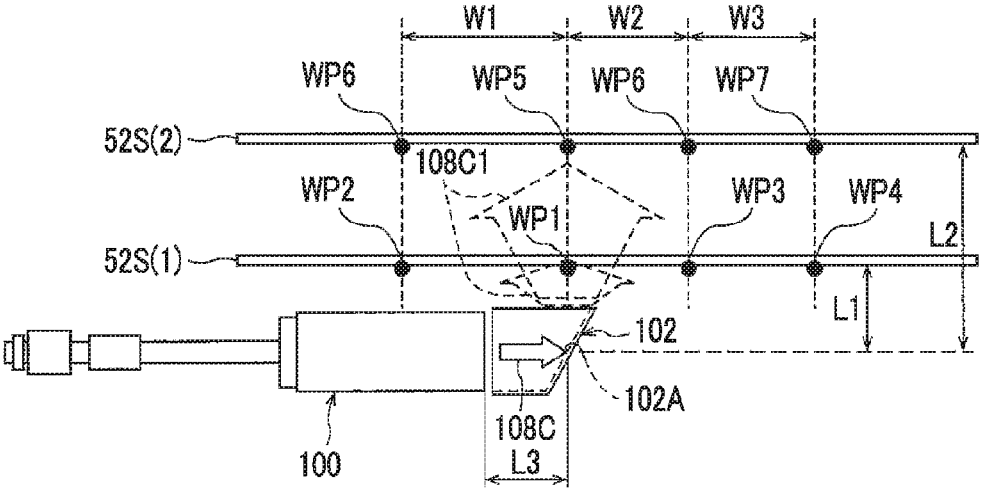
FIG. 9 is a view showing a positional relationship between the gas compressor, the guide part, and the image forming drum and illustrating a cooling effect and a diffusion effect of compressed gas of the first embodiment.
Figure 10B:
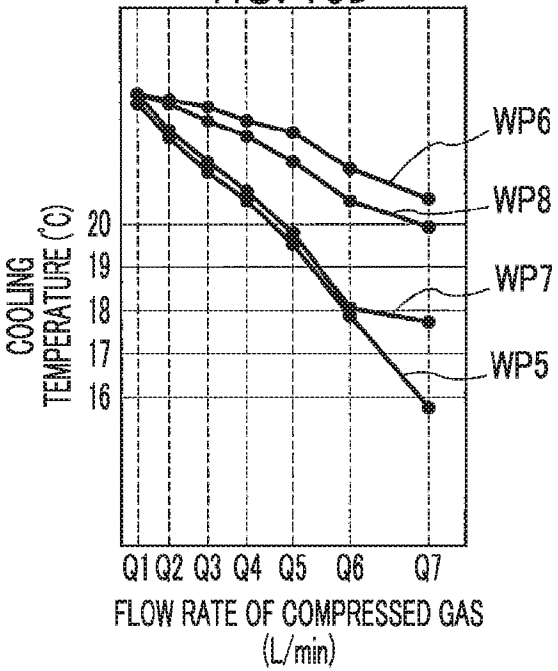
FIGS. 10A and 10B are views showing relationships between the flow rates of compressed gas of the first embodiment and cooling temperatures.
Figure 10A:
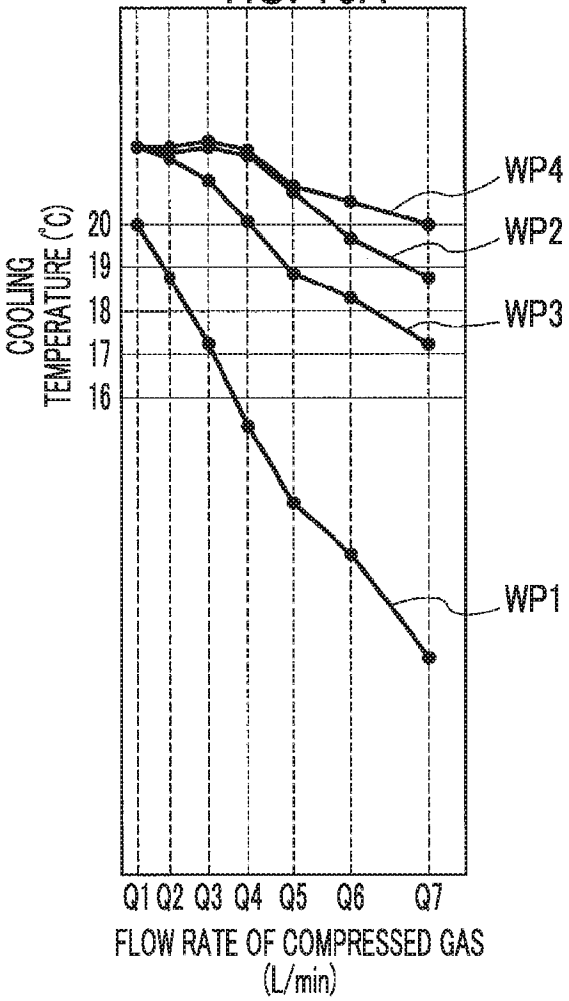

Here, the cooling effect and the diffusion effect of the secondary compressed gas 108C will be described. FIG. 9 shows the configuration of an experiment that is performed by the inventor, and FIGS. 10A and 10B show the results of the experiment. As shown in FIG. 9, a peripheral surface 52S(1) of the image forming drum 52 faces the center position of the guide plate 102A of the guide part 102 with a distance L1 interposed therebetween. The temperature of the secondary compressed gas 108C was measured at four measurement points WP1 to WP4 on the peripheral surface 52S(1). Further, a peripheral surface 52S(2) of the image forming drum 52 faces the center position of the guide plate 102A of the guide part 102 with a distance L2 interposed therebetween. The temperature of the secondary compressed gas 108C was measured at four measurement points WP5 to WP8 on the peripheral surface 52S(2). The distance L1 is 50 mm and the distance L2 is 120 mm The cold air outlet 100E of each gas compressor 100 is spaced apart from the central position of the guide plate 102A by a distance L3. The distance L3 is 50 mm The measurement points WP1 and WP5 are positioned immediately above the central position of the guide plate 102A. The measurement points WP2 and WP6 are present at positions that are spaced apart from the measurement points WP1 and WP5 toward the end of the image forming drum 52 by a width W1. The measurement points WP3 and WP7 are present at positions that are spaced apart from the measurement points WP1 and WP5 toward the middle of the image forming drum 52 by a width W2. The measurement points WP4 and WP8 are present at positions that are spaced apart from the measurement points WP3 and WP7 toward the middle of the image forming drum 52 by a width W3. The width W1 is 100 mm, and each of the widths W2 and W3 is 75 mm FIG. 10A shows a relationship between cooling temperatures T(° C.) and the flow rates Q (L/min) of the primary compressed gas 106C that are measured at the measurement points WP1 to WP4 on the peripheral surface 52S(1). A flow rate Q1 is 50 L/min, a flow rate Q2 is 100 L/min, a flow rate Q3 is 150 L/min, a flow rate Q4 is 200 L/min, a flow rate Q5 is 300 L/min, a flow rate Q6 is 400 L/min, and a flow rate Q7 is 500 L/min. When a distance between the guide plate 102A and the peripheral surface 52S(1) is a short distance L1, the temperature measured at the measurement point WP1 positioned immediately above the guide part 102 is significantly lower than the temperatures measured at the other measurement points WP2 to WP4 but a drop in the temperature measured at each of the measurement points WP2 to WP4 appears as shown in FIG. 10A. That is, since the peripheral surface 52S(1) of the image forming drum 52 can be cooled in a wide range along the direction of the rotation axis C, the cooling efficiency of the image forming drum 52 can be improved.

FIG. 10B shows a relationship between cooling temperatures T(° C.) and the flow rates Q (L/min) of the primary compressed gas 106C that are measured at the measurement points WP5 to WP8 on the peripheral surface 52S(2). Flow rates Q1 to Q7 are the same as the above-mentioned flow rates Q1 to Q7. When a distance between the guide plate 102A and the peripheral surface 52S(2) is a long distance L2, the temperature measured at the measurement point WP5 positioned immediately above the guide part 102 is slightly lower than the temperatures measured at the other measurement points WP6 to WP8 as shown in FIG. 10B. A drop in the temperature measured at each of the measurement points WP6 to WP8 appears as in the case of a drop in the temperature measured at each of the measurement points WP2 to WP4. That is, since the peripheral surface 52S(2) of the image forming drum 52 can be cooled in a wide range along the direction of the rotation axis C, the cooling efficiency of the image forming drum 52 can be improved. In the experiment, it was confirmed that dew condensation does not occur when the temperature of the peripheral surface 52S(2) is cooled down to 20° C. or less. In this case, the flow rate Q of the primary compressed gas 106C was 250 L/min or more and the pressure of the primary compressed gas 106C was 0.4 MPa or more. When the flow rate Q is further increased, the performance of the gas compressor 100 can be further improved but the size of the compressed gas generating source 120 is increased and costs are increased. For this reason, the practical upper limit of the flow rate is 1200 L/min Further, when pressure is further increased, the performance of the gas compressor 100 can be further improved but the size of the compressed gas generating source 120 is increased and costs are increased. For this reason, the practical upper limit of pressure is 0.8 MPa. The practical range of pressure and the practical range of the flow rate vary depending on the type and size of the gas compressor 100 to be used, the type of gas, and the like.

In addition, since the length of the flow passage of the secondary compressed gas 108C is made along the direction of the rotation axis C of the image forming drum 52 as shown in FIG. 4 in the image forming apparatus 10 according to this embodiment, the size of a space, which is required to ensure the length of the flow passage, is reduced. For this reason, the size of the image forming apparatus 10 can be reduced.

Further, since the guide part 102 includes the guide plate 102A that is set to an interior angle α in the range of 30° to 50° as shown in FIG. 8B in the image forming apparatus 10 according to this embodiment, it is possible to reduce the amount of the secondary compressed gas 108C that wastefully flows to the end and the middle of the image forming drum from the gas compressor 100 in the direction of the rotation axis C of the image forming drum 52. For this reason, since the secondary compressed gas 108C can be guided to the peripheral surface 52S of the image forming drum 52 without waste, the cooling efficiency of the image forming drum 52 can be improved. In addition, since the secondary compressed gas 108C can be guided by the plate-like guide plate 102A, the structure of the guide part 102 is simplified.

Further, in the image forming apparatus 10 according to this embodiment, the guide walls 102B and 102C stand at both end portions of the guide plate 102A and the secondary compressed gas 108C is also guided in the circumferential direction of the image forming drum 52 by the guide walls 102B and 102C. For this reason, since the secondary compressed gas 108C is also blown in the circumferential direction of the image forming drum 52, the cooling efficiency of the image forming drum 52 can be further improved.

Furthermore, it is possible to collect the secondary compressed gas 108C, which is to be diffused in a direction in which the secondary compressed gas 108C deviates from the image forming drum 52, and to guide the secondary compressed gas 108C to the peripheral surface 52S of the image forming drum 52 by the guide plate 102A and the guide walls 102B and 102C of the guide part 102 shown in FIGS. 8A and 8C. For this reason, since the secondary compressed gas 108C is efficiently used, the cooling efficiency of the image forming drum 52 can be further improved.

Moreover, as shown in FIG. 1, the treatment liquid drying processing section 16 serving as a heat generating source is provided on the upstream side of the image forming drum 52 in the transport direction of the recording medium P and the drying processing section 21 serving as a heat generating source is provided on the downstream side in the transport direction. Since the secondary compressed gas 108C is also guided in the circumferential direction of the image forming drum 52 by the guide walls 102B and 102C, the wall of the secondary compressed gas 108C can be formed between the image forming drum 52 and each heat generating source. For this reason, since heat, which is transferred to the image forming drum 52 from the heat generating sources, is blocked by the secondary compressed gas 108C, a rise in the temperature of the image forming drum 52 can be effectively suppressed.

Further, since the guide part 102 is provided immediately below the image forming drum 52 in the image forming apparatus 10 according to this embodiment as shown in FIG. 5, the length of the flow passage to the peripheral surface 52S of the image forming drum 52 from the guide part 102 is shortest. For this reason, since the secondary compressed gas 108C is blown to the peripheral surface 52S of the image forming drum 52 while maintaining a low temperature, the cooling efficiency of the image forming drum 52 can be further improved.

Furthermore, since the guide part 102 is provided on the downstream side of a position, which is present immediately below the image forming drum 52, in the transport direction in the image forming apparatus 10 according to this embodiment as shown in FIG. 5, more secondary compressed gas 108C can be guided to the downstream side in the transport direction than the upstream side in the transport direction in the circumferential direction of the image forming drum 52. For this reason, since the wall of the secondary compressed gas 108C can be formed between the image forming drum 52 and the drying processing section 21 that is the largest heat generating source and heat, which is transferred to the image forming drum 52 from the heat generating source, is blocked by the secondary compressed gas 108C, a rise in the temperature of the image forming drum 52 can be effectively suppressed.

Further, since the guide part 102 is made of a material having low thermal conductivity in the image forming apparatus 10 according to this embodiment, the heat loss of the secondary compressed gas 108C can be reduced in the guide part 102. For this reason, since the secondary compressed gas 108C, which is maintained at a low temperature, is blown to the peripheral surface 52S of the image forming drum 52 from the gas compressors 100, the cooling efficiency of the image forming drum 52 can be further improved.

Furthermore, since the compressed gas generating source 120 supplying the primary compressed gas 106C is provided outside the apparatus in the image forming apparatus 10 according to this embodiment as shown in FIG. 2, only the gas compressors 100 are provided in the apparatus. For this reason, the structure of an apparatus body is simplified and the size of the apparatus body can be reduced.

Figure 11:
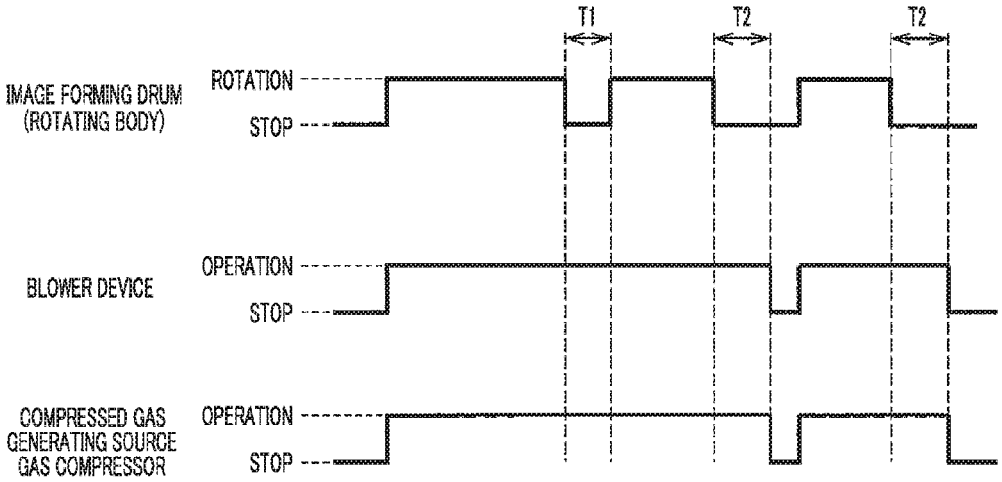
FIG. 11 is a timing chart showing operations of the image forming drum, the blower device, the compressed gas generating source, and the gas compressor of the image forming apparatus shown in FIG. 2.

Further, in the image forming apparatus 10 according to this embodiment, as shown in FIG. 2, the primary compressed gas 106C is supplied to the gas compressors 100 from the compressed gas generating source 120 in synchronization with the operation of the blower device 142 of the air station 130. In detail, since the blower device 142 of the air station 130 is in an operating state as shown in FIG. 11 in a case in which an image forming operation is performed and the image forming drum 52 is being rotated, heat generated in the image forming apparatus 10 is discharged to the outside 162. Since the compressed gas generating source 120 is in an operating state in synchronization with the blower device 142, the primary compressed gas 106C is supplied to the gas compressors 100 from the compressed gas generating source 120. Accordingly, the secondary compressed gas 108C is blown to the peripheral surface 52S of the image forming drum 52 from the gas compressor 100, so that the image forming drum 52 is cooled.

Here, the operation of the image forming drum 52 is stopped in the range of time T1. The time T1 is short time less than, for example, 30 minutes. At this time, since there is time lag in the discharge of heat of the image forming apparatus 10, the blower device 142 is operating. Accordingly, the primary compressed gas 106C is supplied to the gas compressors 100 from the compressed gas generating source 120 and the secondary compressed gas 108C is blown to the peripheral surface 52S of the image forming drum 52 from the gas compressors 100. As a result, the image forming drum 52 is cooled. When time T2 has passed after the operation of the image forming drum 52 is stopped, the operation of the blower device 142 is stopped. The time T2 is long time of, for example, 30 minutes or more. Accordingly, since the operation of the compressed gas generating source 120 is stopped in synchronization with the blower device 142, the supply of the primary compressed gas 106C to the gas compressor 100 from the compressed gas generating source 120 is stopped and the blowing of the secondary compressed gas 108C from the gas compressor 100 is stopped. When the operation of the image forming drum 52 is started, the operation of the blower device 142 is started. Then, the primary compressed gas 106C is supplied to the gas compressor 100 from the compressed gas generating source 120 in synchronization with the operation of the blower device 142.

Accordingly, according to the image forming apparatus 10 of this embodiment, the apparatus body does not require control means for the supply of the primary compressed gas 106C. For this reason, the structure of the apparatus body of the image forming apparatus 10 is simplified and the size of the apparatus body can be reduced.

Further, in the image forming apparatus 10 according to this embodiment, the gas compressors 100 can simply generate the secondary compressed gas 108C, which has low temperature, from the primary compressed gas 106C by a vortex effect.

Furthermore, in the image forming apparatus 10 according to this embodiment, the image forming drum 52 can hold a recording medium P by receiving and winding the recording medium P while rotating. Accordingly, the length, which has a long length, of the transport path of the recording medium P in the rotation direction of the image forming drum 52 is obtained. For this reason, the size of the apparatus body can be reduced.

Second Embodiment

A second embodiment of the invention will be described with reference to FIGS. 12A to 12D. In the second embodiment, the same components as the components of the first embodiment are denoted by the same reference numerals as the reference numerals of the first embodiment and the repeated description thereof will be omitted.

Figure 12A:
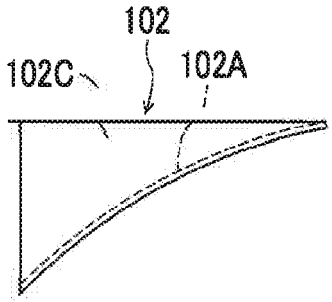
FIGS. 12A to 12D are side views of a guide part of an image forming apparatus according to a second embodiment of the invention corresponding to FIG. 8B.

In the image forming apparatus 10 according to this embodiment, the surface of the guide plate 102A of the guide part 102 is formed of a curved surface that protrudes toward the peripheral surface 52S (see FIG. 5) of the image forming drum 52 and guides the secondary compressed gas 108C as shown in FIG. 12A.

Figure 12B:
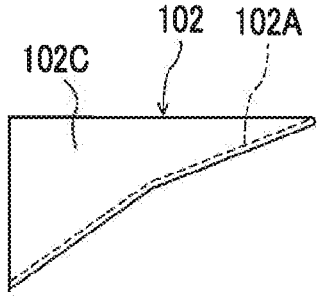

Further, in the image forming apparatus 10 according to this embodiment, the surface of the guide plate 102A of the guide part 102 is formed of a polygonal surface that protrudes toward the peripheral surface 52S of the image forming drum 52 and guides the secondary compressed gas 108C as shown in FIG. 12B.

Since the guide part 102 includes a curved surface or a polygonal surface protruding toward the peripheral surface 52S of the image forming drum 52 in the image forming apparatus 10 according to this embodiment, the secondary compressed gas 108C, which is guided from the gas compressors 100 by the guide parts 102, can be further diffused in the direction of the rotation axis C of the image forming drum 52. For this reason, the peripheral surface 52S of the image forming drum 52 can be cooled in a wide range along the direction of the rotation axis C.

Figure 12C:
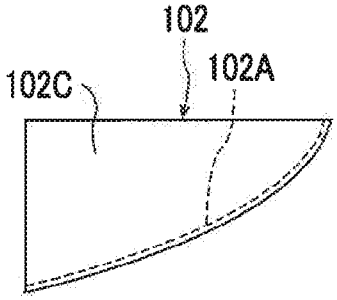

Furthermore, the surface of the guide plate 102A of the guide part 102 is formed of a curved surface that is recessed toward the side opposite to the peripheral surface 52S of the image forming drum 52 and guides the secondary compressed gas 108C as shown in FIG. 12C.

Figure 12D:
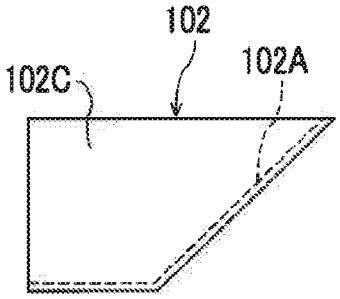

Moreover, the surface of the guide plate 102A of the guide part 102 is formed of a polygonal surface that is recessed toward the side opposite to the peripheral surface 52S of the image forming drum 52 and guides the secondary compressed gas 108C as shown in FIG. 12D.

Since the guide part 102 includes a curved surface or a polygonal surface recessed toward the side opposite to the peripheral surface 52S of the image forming drum 52 in the image forming apparatus 10 according to this embodiment, it is possible to cool a specific portion of the peripheral surface 52S of the image forming drum 52 with the secondary compressed gas 108C, which is guided from the gas compressors 100 by the guide parts 102, by aiming a target.

(Other Examples)

The invention has been described above using the embodiments, but the invention is not limited to the embodiments and may have various modifications without departing from the scope of the invention. For example, in the invention, gas, such as nitrogen, other than air may be compressed to form the primary compressed gas 106C. Further, the invention is not limited to two gas compressors 100 and may include one or three or more gas compressors 100. In a case in which a plurality of gas compressors 100 are provided, each of the gas compressors 100 is adapted to blow the secondary compressed gas 108C along the direction of the rotation axis C of the image forming drum 52 but the position thereof in the transport direction may deviate.

Furthermore, the compressed gas generating source 120 has been adapted to operate in synchronization with the blower device 142 in the embodiments, but the compressed gas generating source 120 may be adapted to operate alone. Moreover, the invention may be applied to an image forming apparatus that forms a circuit substrate or a liquid crystal substrate by discharging conductive liquid droplets or insulating liquid droplets.

EXPLANATION OF REFERENCES

10: image forming apparatus
52: image forming drum (recording medium transport unit)
52S: peripheral surface
56M, 56K, 56C, 56Y: ink discharge head (liquid discharge head)
100: gas compressor
100E: cold air outlet (outlet)
102: guide part
102A: guide plate
102B, 102C: guide wall
120: compressed gas generating source
130: air station
142: blower device

What is claimed is:

1. An image forming apparatus comprising:

a recording medium transport unit that is adapted to be capable of transporting a recording medium, which is capable of being held on an outer peripheral portion thereof, from one side of a rotation axis thereof to the other side of the rotation axis by rotating;

a liquid discharge head that faces the outer peripheral portion of the recording medium transport unit in a transport range in which the recording medium transport unit is capable of transporting the recording medium and is capable of forming an image on the recording medium by discharging liquid to the recording medium, which is capable of being transported by the recording medium transport unit; and a gas compressor that faces a range positioned outside the transport range deviating from the transport range in a circumferential direction, of the outer peripheral portion of the recording medium transport unit, generates secondary compressed gas, of which the temperature is lower than the temperature of primary compressed gas supplied from the outside of the apparatus, from the primary compressed gas, and blows the secondary compressed gas to the range positioned outside the transport range.

2. The image forming apparatus according to claim 1, wherein the gas compressor includes an outlet that blows the secondary compressed gas along a direction of the rotation axis, and the image forming apparatus further comprising:

a guide part that guides the secondary compressed gas, which is blown from the outlet, to the range positioned outside the transport range and diffuses the secondary compressed gas in at least the direction of the rotation axis.

3. The image forming apparatus according to claim 2, wherein the guide part includes a guide plate that guides the flow of the secondary compressed gas, and an interior angle between a surface of the guide plate and the rotation axis of the recording medium transport unit is in the range of 30° to 50°.

4. The image forming apparatus according to claim 2, wherein the guide part is provided immediately below the recording medium transport unit.

5. The image forming apparatus according to claim 4, wherein the guide part is made of a material that has a thermal conductivity lower than the thermal conductivity of the recording medium transport unit.

6. The image forming apparatus according to claim 2, wherein the guide part is provided on the downstream side of a position, which is present immediately below the recording medium transport unit, in a transport direction of the recording medium.

7. The image forming apparatus according to claim 2, wherein the guide part includes a curved surface or a polygonal surface that protrudes toward a peripheral surface of the recording medium transport unit and guides the secondary compressed gas, or a curved surface or a polygonal surface that is recessed toward a side opposite to the peripheral surface of the recording medium transport unit and guides the secondary compressed gas.

8. The image forming apparatus according to claim 2, wherein the guide part is made of a material that has a thermal conductivity lower than the thermal conductivity of the recording medium transport unit.

9. The image forming apparatus according to claim 3, wherein guide walls, which guide the secondary compressed gas in a circumferential direction of the recording medium transport unit, stand at both end portions of the guide plate.

10. The image forming apparatus according to claim 3, wherein the guide part is provided immediately below the recording medium transport unit.

11. The image forming apparatus according to claim 10, wherein the guide part is made of a material that has a thermal conductivity lower than the thermal conductivity of the recording medium transport unit.

12. The image forming apparatus according to claim 3, wherein the guide part is provided on the downstream side of a position, which is present immediately below the recording medium transport unit, in a transport direction of the recording medium.

13. The image forming apparatus according to claim 3, wherein the guide part is made of a material that has a thermal conductivity lower than the thermal conductivity of the recording medium transport unit.

14. The image forming apparatus according to claim 9, wherein the guide part is provided immediately below the recording medium transport unit.

15. The image forming apparatus according to claim 9, wherein the guide part is provided on the downstream side of a position, which is present immediately below the recording medium transport unit, in a transport direction of the recording medium.

16. The image forming apparatus according to claim 9, wherein the guide part is made of a material that has a thermal conductivity lower than the thermal conductivity of the recording medium transport unit.

17. The image forming apparatus according to claim 1, wherein the recording medium transport unit is capable of holding the recording medium by receiving and winding the recording medium while rotating.

18. The image forming apparatus according to claim 1, wherein the gas compressor is connected to a compressed gas generating source that is provided outside the apparatus and supplies the primary compressed gas.

19. The image forming apparatus according to claim 18, wherein the compressed gas generating source is connected to a blower device that is provided outside the apparatus and discharges heat present in the apparatus to the outside, and is adapted to supply the primary compressed gas to the gas compressor in synchronization with an operation of the blower device.

20. The image forming apparatus according to claim 1, wherein the gas compressor is adapted to generate the secondary compressed gas from the primary compressed gas by a vortex effect.

* * * * *